US005306878A

United States Patent [19]

Kubo

[11] Patent Number: 5,306,878

[45] Date of Patent: Apr. 26, 1994

[54] METHOD AND APPARATUS FOR ELEVATOR GROUP CONTROL WITH LEARNING BASED ON GROUP CONTROL PERFORMANCE

[75] Inventor: Susumu Kubo, Tokyo, Japan

[73] Assignee: Kabushiki Kaisha Toshiba, Kawasaki, Japan

[21] Appl. No.: 591,887

[22] Filed: Oct. 2, 1990

[30] Foreign Application Priority Data

Oct. 9, 1989 [JP] Japan ..... 1-262178

[51] Int. Cl.[5] ..... B66B 1/18

[52] U.S. Cl. ..... 187/127; 187/124

[58] Field of Search ..... 187/124, 127, 100, 121; 364/513

[56] References Cited

U.S. PATENT DOCUMENTS

| | | | |
|---|---|---|---|
| 4,562,530 | 12/1985 | Umeda et al. | 187/100 |
| 4,672,531 | 6/1987 | Uetani | 187/124 |
| 4,709,788 | 12/1987 | Harada | 187/124 |
| 4,760,896 | 8/1988 | Yamaguchi | 187/124 |
| 4,815,568 | 3/1989 | Bittar | 87/127 |
| 4,860,207 | 8/1989 | Kubo | 364/424.01 |
| 4,947,965 | 8/1990 | Kuzunuki et al. | 187/127 |
| 4,984,174 | 1/1991 | Yasunobu et al. | 364/513 |
| 5,012,430 | 4/1991 | Sakurai | 364/513 |
| 5,022,497 | 6/1991 | Thanagavelu | 187/124 |
| 5,022,498 | 6/1991 | Sasaki et al. | 187/127 |
| 5,040,215 | 8/1991 | Amano et al. | 381/43 |
| 5,046,019 | 9/1991 | Basehore | 395/3 |

FOREIGN PATENT DOCUMENTS

| | | |
|---|---|---|
| 2141843A | 1/1985 | United Kingdom . |
| 2168827A | 6/1986 | United Kingdom . |
| 2216683A | 10/1989 | United Kingdom . |
| 2231689A | 11/1990 | United Kingdom . |

*Primary Examiner*—Steven L. Stephan
*Assistant Examiner*—Robert Nappi
*Attorney, Agent, or Firm*—Foley & Lardner

[57] ABSTRACT

A method and an apparatus for elevator group control, capable of performing the elevator car allocation control with the evaluation characteristics and the control parameters which are most appropriate for a unique situation of each building. In the apparatus, a hall call allocation control to determine a most appropriate one of the elevator cars to respond to a hall call produced at one of the destination floor, is performed by carrying out evaluations in accordance with a given traffic demand of the elevator system; and the control parameters to be utilized in carrying out the evaluations, are determined in accordance with a response resulting from the hall call allocation control and the given traffic demand.

6 Claims, 12 Drawing Sheets

METHOD AND APPARATUS FOR ELEVATOR GROUP CONTROL WITH LEARNING BASED ON GROUP CONTROL PERFORMANCE

BACKGROUND OF THE INVENTION

1. Field of the Invention

The present invention relates to a method and an apparatus for elevator group control by which an elevator system including a plurality of elevator cars and a plurality of destination floors are controlled.

2. Description of the Background Art

Recently, an elevator system including a plurality of elevator cars and a plurality of destination floors is equipped with a microcomputer to administer efficient and speedy allocations of elevator cars to hall calls produced at various destination floors, so as to improve the efficiency of elevator utilization and the quality of service.

Namely, in such an elevator system, when a hall call is produced at a certain floor, an elevator car which is most appropriate to respond to this hall call is selected from the plurality of elevator cars of the system, while the other elevator cars are prohibited to respond to this hall call.

More recently, a group controlled elevator system has been developed in which an elevator group control apparatus can perform the elevator car allocation control by gathering so called elevator car call response registration data regarding hall calls to which each elevator car has responded, so as to apprehend traffic demands among the floors of each building, and by utilizing these data to the elevator car allocation control, so as to account for a unique situation characteristic to each building. In this type of the elevator car allocation control, various evaluation characteristics are set up in accordance with the characteristics of each building, evaluation values for these evaluation characteristics are estimated, the evaluation values are multiplied by appropriate weight factors functioning as control parameters and then summed to obtain a total evaluation for each elevator car, and the most appropriate elevator car is selected from the plurality of elevator cars in accordance with the total evaluations obtained for the plurality of elevator cars.

However, because the relative importance of each of the evaluation characteristics for the elevator car allocation control changes radically depending on the traffic situation, so that ideally the control parameters have to be selected, appropriately in accordance with the traffic situation. Such an optimization of the control parameters in accordance with continuously changing traffic situation of the elevator system has conventionally been impossible.

Also, because the evaluation characteristics for the elevator car allocation control varies widely depending on various characteristics of each building, such as a type of usage and a type of tenant, so that the evaluation characteristics have to be selected in accordance with such characteristics of each building, an automatic setting of the evaluation characteristics has conventionally been impossible. Conventionally, the evaluation characteristics are selected by each building's administrator, and then numerous simulations are performed in order to determine the appropriate control parameters before the actual use of the elevator system begins. Thus procedure requires an enormous number of simulations to be performed, and moreover, the results of such simulations are still not capable of reflecting all the characteristics of each elevator system, such that it has been possible that the intended efficiency and speediness may not be obtained by the selected control parameters.

SUMMARY OF THE INVENTION

It is therefore an object of the present invention to provide a method and an apparatus for elevator group control, capable of performing the elevator car allocation control with the evaluation characteristics and the control parameters which are most appropriate for a unique situation of each building.

According to one aspect of the present invention there is provided an elevator group control apparatus for controlling an elevator system including a plurality of elevator cars and a plurality of destination floors, comprising: group control unit for performing a hall call allocation control to determine a most appropriate one of the elevator cars to respond to a hall call produced at one of the destination floor, by carrying out evaluations in accordance with a given traffic demand of the elevator system; and learning control unit for determining the control parameters to be utilized by the group control unit in carrying out the evaluations, in accordance with a response resulting from the hall call allocation control by the group control unit and the given traffic demand.

According to another aspect of the present invention there is provided a method of elevator group control for controlling an elevator system including a plurality of elevator cars and a plurality of destination floors, comprising the steps of: performing a hall call allocation control to determine a most appropriate one of the elevator cars to respond to a hall call produced at one of the destination floors, by carrying out evaluations in accordance with a given traffic demand of the elevator system; and determining the control parameters to be utilized at the performing step in carrying out the evaluations, in accordance with a response resulting from the hall call allocation control and the given traffic demand.

Other features and advantages of the present invention will become apparent from the following description taken in conjunction with the accompanying drawings.

DETAILED DESCRIPTION OF THE PREFERRED EMBODIMENTS

Figure 1:
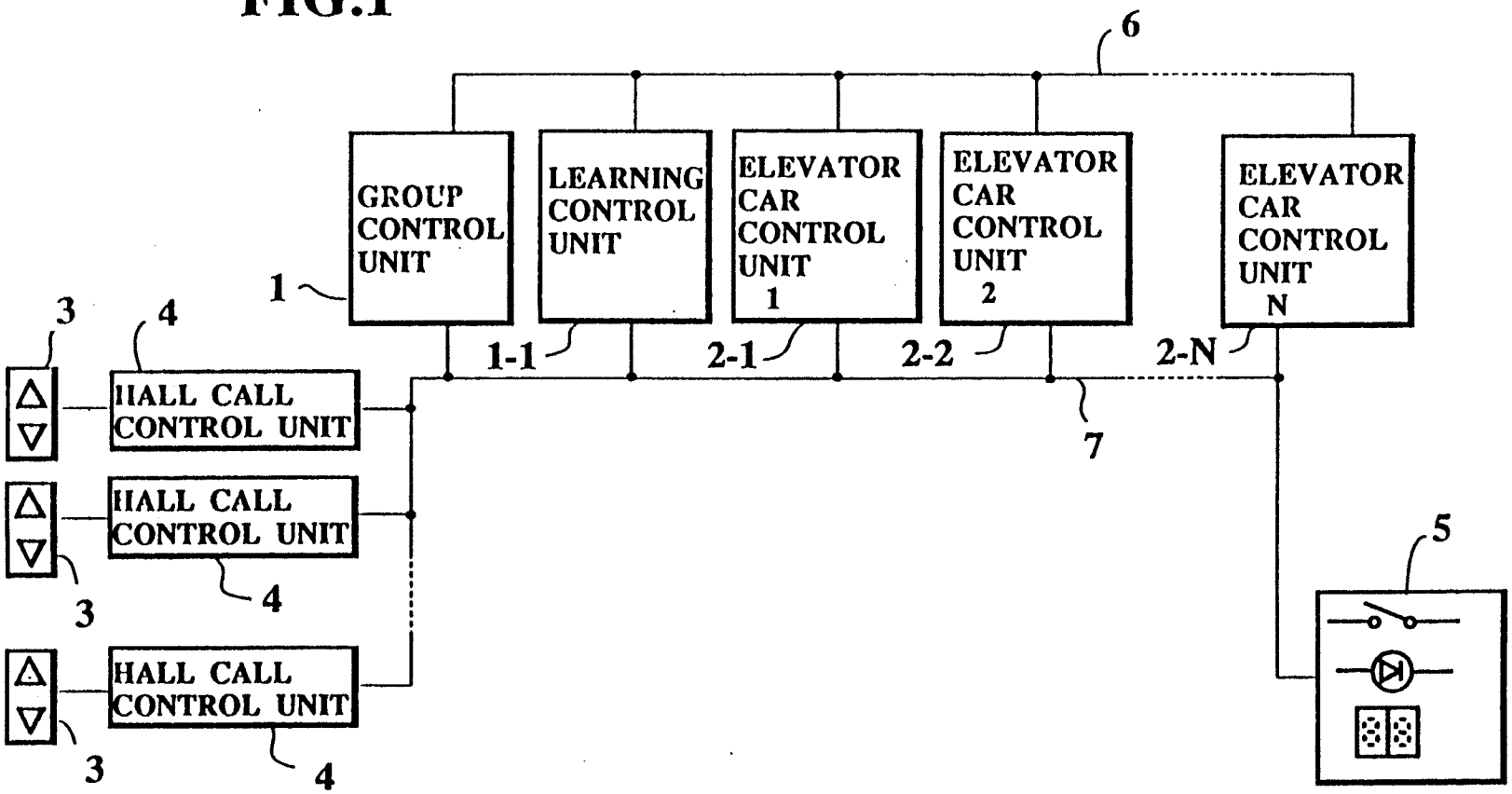
FIG. 1 is a schematic block diagram of one embodiment of an elevator group control apparatus according to the present invention.

Referring now to FIG. 1, there is shown one embodiment of the elevator group control apparatus according to the present invention.

In this embodiment, the elevator group control apparatus comprises: a group control unit 1; a learning control unit 1—1; and a plurality (N in number) of elevator car control units 2-1 to 2-N provided in correspondence with N elevator cars incorporated in an elevator system; all of which are connected through a high speed data transmission line 6. These group control unit 1, learning control unit 1—1, and elevator car control units 2-1 to 2-N are constructed from one or more of computer devices such as micro-computers which are operated by an appropriate software system.

The apparatus also includes hall call buttons 3 provided on each floor of a building in which the elevator system operates; hall call control units 4 provided for each hall call buttons 3 at each floor; and a monitor unit 5. These hall call control units 4 are connected with the group control unit 1, learning control unit 1—1, and elevator car control units 2-1 to 2-N through a low speed data transmission line 7.

The high speed data transmission line 6 is a high speed, high intelligent network, for providing high speed transmissions of data required for the elevator group control among the group control unit 1, learning control unit 1—1, and elevator car control units 2-1 to 2-N, all of which are placed in a designated control unit room of the building.

The low speed data transmission line 7 is relatively slower than the high speed data transmission line 6, and is for providing low speed transmissions of data among the hall call buttons 3, group control unit 1, learning control unit 1—1, elevator car control units 2-1 to 2-N, and the monitor unit 5, which are located at various positions inside the building. This low speed data transmission line 7 is made of an optical fiber cable so as to be able to cover a large distance required for it.

Under a normal controlling by the group control unit 1, the hall call buttons 3 are controlled by the group control unit 1 though the low speed data transmission line 7, and in response to a pressing of one of the hall call buttons 3, a corresponding hall call gate (not shown) is closed to turn on a registration lamp provided in conjunction with the hall cal buttons 3, while a most appropriate elevator car to respond to this hall call is selected in accordance with the information given by the elevator car control units 2-1 to 2-N, and an appropriate command is given to a corresponding one of the elevator car control units 4 so that the corresponding one of the elevator car control units 4 can control the most appropriate elevator car in accordance with this command.

Figure 2:
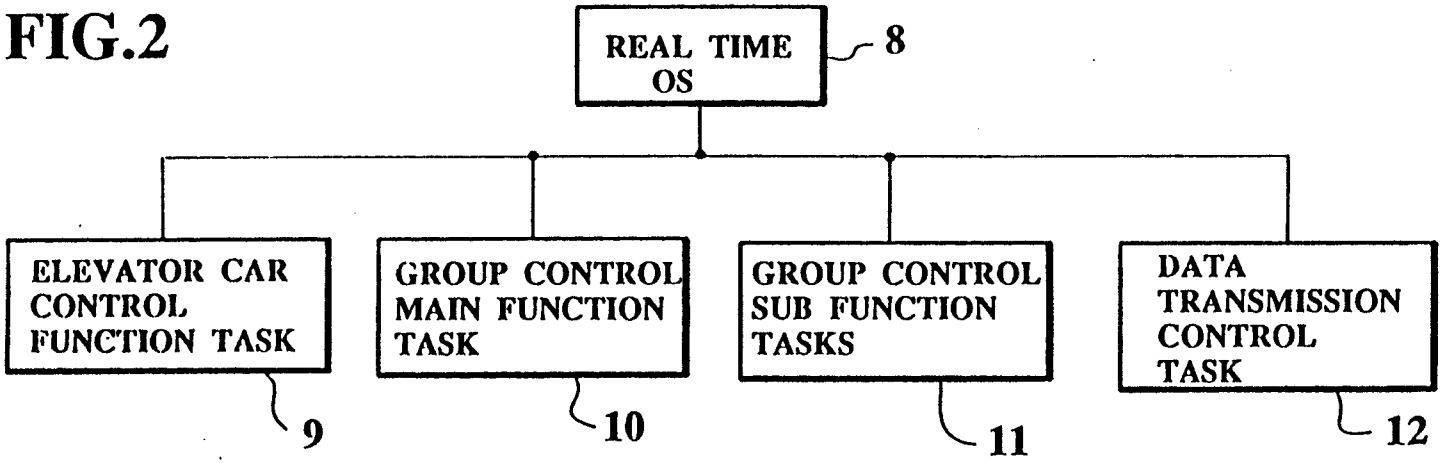
FIG. 2 is a diagram representing a structure of a software system to be utilized in the apparatus of FIG. 1.

A software system for operating the group control unit 1 and the elevator car control units 2-1 to 2-N is shown diagrammatically in FIG. 2, which includes a real time OS 8 as an operating system, an elevator car control function task 9, a group control main function task 10, group control sub function tasks 11, and a data transmission control task 12, where the real time OS 8 controls each of the other tasks 9-12 according to a schedular given to the real time OS 8.

The elevator car control function task 9 is a function for activating the elevator car control units 2-1 to 2-N, which is given a high priority.

The group control main function task 10 is a function central to the group control unit 1, which collects information data for each elevator car from the group control sub function tasks 11 which are distributed to the elevator car control units 2-1 to 2-N, carries out calculations on the collected information data to determine a most appropriate elevator car, and control the corresponding one of the elevator car control units 2-1 to 2-N, while controlling the hall call registrations at the hall call control units 4.

The group control sub function tasks 11 are the function for processing the information of each elevator car under the control of the group control main function task 10. Namely, the group control sub function tasks 11 are activated by a command from a computer operated by the group control main function task 10 to perform information processings for the elevator cars in parallel, and returns the obtained resultant data to the group control main function task 10.

The data transmission control task 12 is for controlling the data transmissions through the high speed data transmission line 6 as well as the activation of the group control sub function tasks 11 in accordance with the group control main function task 10.

Figure 3:
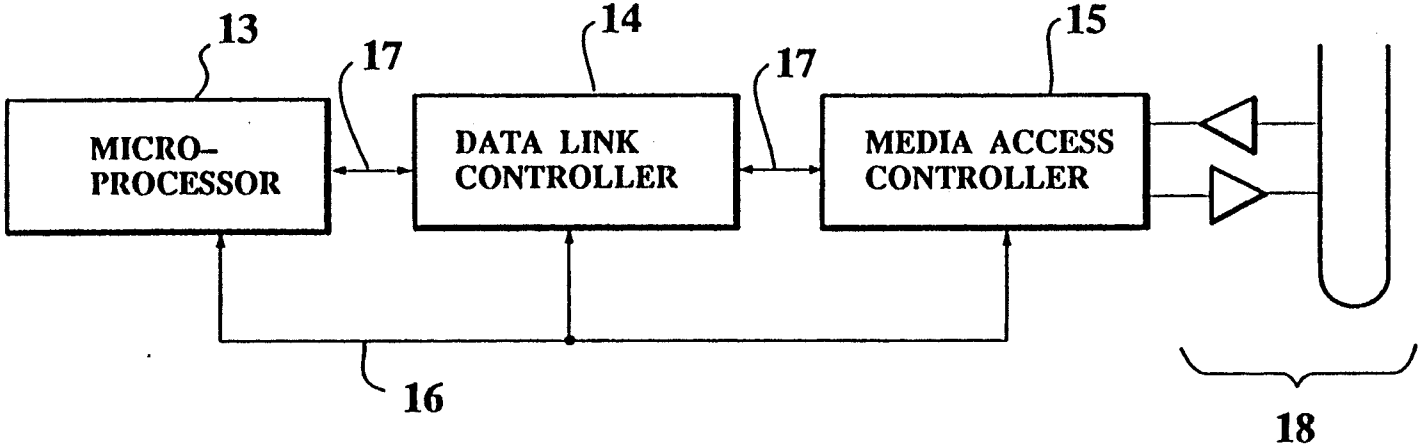
FIG. 3 is a schematic diagram for a configuration of a high speed data transmission line to be utilized in the apparatus of FIG. 1.

A configuration for the high speed data transmission line 6 is shown in FIG. 3.

In this configuration, the data transmission is controlled by a micro-processor 13. Moreover, in order to reduce a size of a data transmission software to be governed by the micro-processor 13, this micro-processor 13 is equipped with a data link controller 14 and a media access controller 15 for controlling a data link class in an LAN network model classes defined by ISO (the international standard organization). The micro-processor 13, the data link controller 14, and the media access controller 15, are connected by a system bus 16, while the micro-processor 13 and the data link controller 14, as well as the data link controller 14 and the media access controller 15 are also connected through control line 17, and the media access controller 15 is further connected to a serial data transmission system 18.

For the data link controller 14, the i82586 processor of the Intel corporation can be used, while for the media access controller 15, the i82501 processor of the Intel corporation can be used. In this configuration, a high speed data transmission such as 10 Mblt/sec can easily be achieved, while reducing the supporting ratio for the micro-processor 13.

Now, the flow of signals among the group control unit 1, learning control unit 1—1, and an elevator group system 2 containing the elevator car control units 2-1 to 2-N will be described with reference to FIG. 4.

Figure 4:
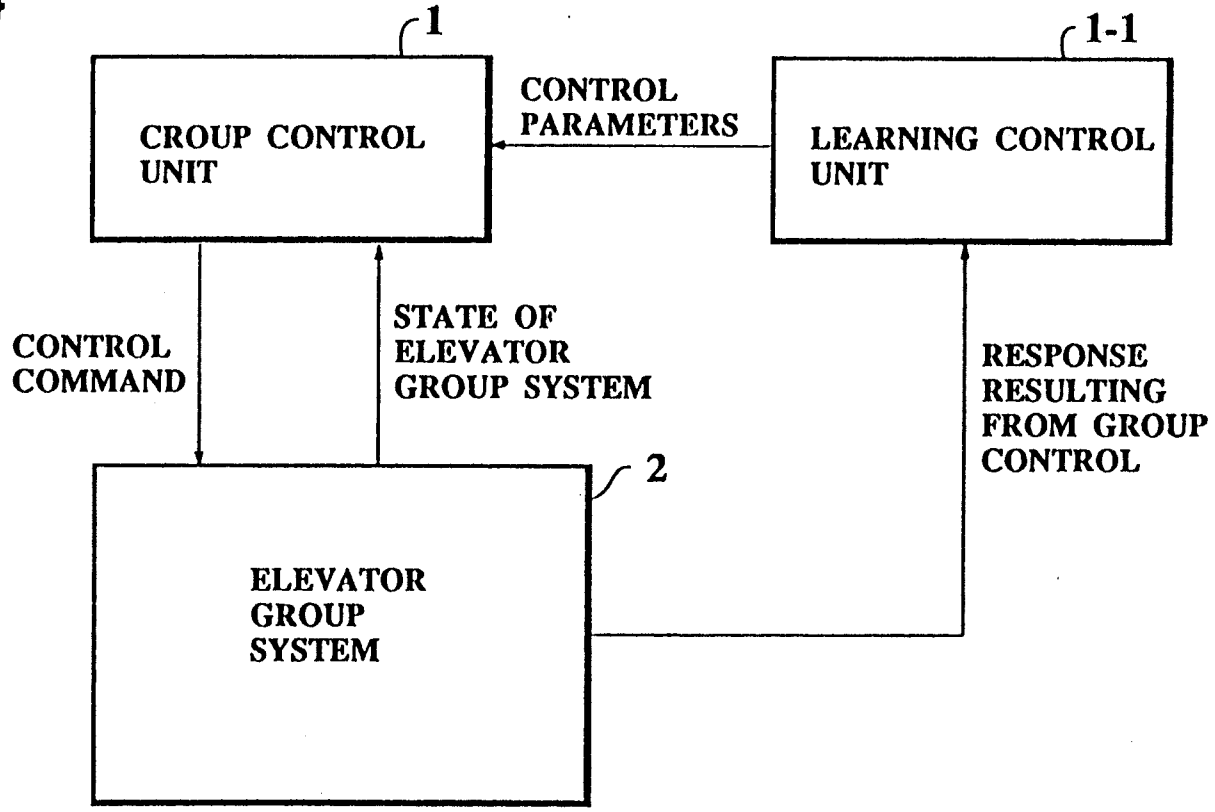
FIG. 4 is a block diagram showing the flow of signals among the elements of the apparatus of FIG. 1.

As shown in FIG. 4, the group control unit 1 performs the hall call allocation control in conjunction with the group control sub function tasks 11 distributed in the elevator car control units 2-1 to 2-N of the elevator group system 2, as described above, by exchanging the control command and the information data on a state of elevator group system 2. Here, an evaluation algorithm utilized in this hall call allocation control is that in which the evaluation is performed by evaluating a number of evaluation characteristics related to the group control performance, and then summing them with appropriate weight factors multiplying the evaluated values of the evaluation characteristics.

The learning control unit 1—1 supplies the appropriate weight factors for multiplying the evaluation characteristics, as control parameters, at a predetermined constant time interval, which are to be used for a prescribed period of time of operation.

Thus, the group control unit 1 evaluates the evaluation characteristics in accordance with the information data obtained from the elevator car control units 2-1 to 2-N, and multiplies the evaluated values of the evaluation characteristics by the control parameters given by the learning control unit 1—1, to determine the most appropriate elevator car.

The learning control unit 1—1 also receives the information on the actual responses of the elevator cars resulting from the group control performed by the group control unit 1 within the prescribed period of time of operation from the elevator car control units 2-1 to 2-N and the hall call control units 4 of the elevator group system 2, which will then be utilized as a data base for the subsequent on-line learning process.

Next, the detail of the learning control unit 1—1 will be described with reference to FIG. 5 to FIG. 7.

Figure 5:
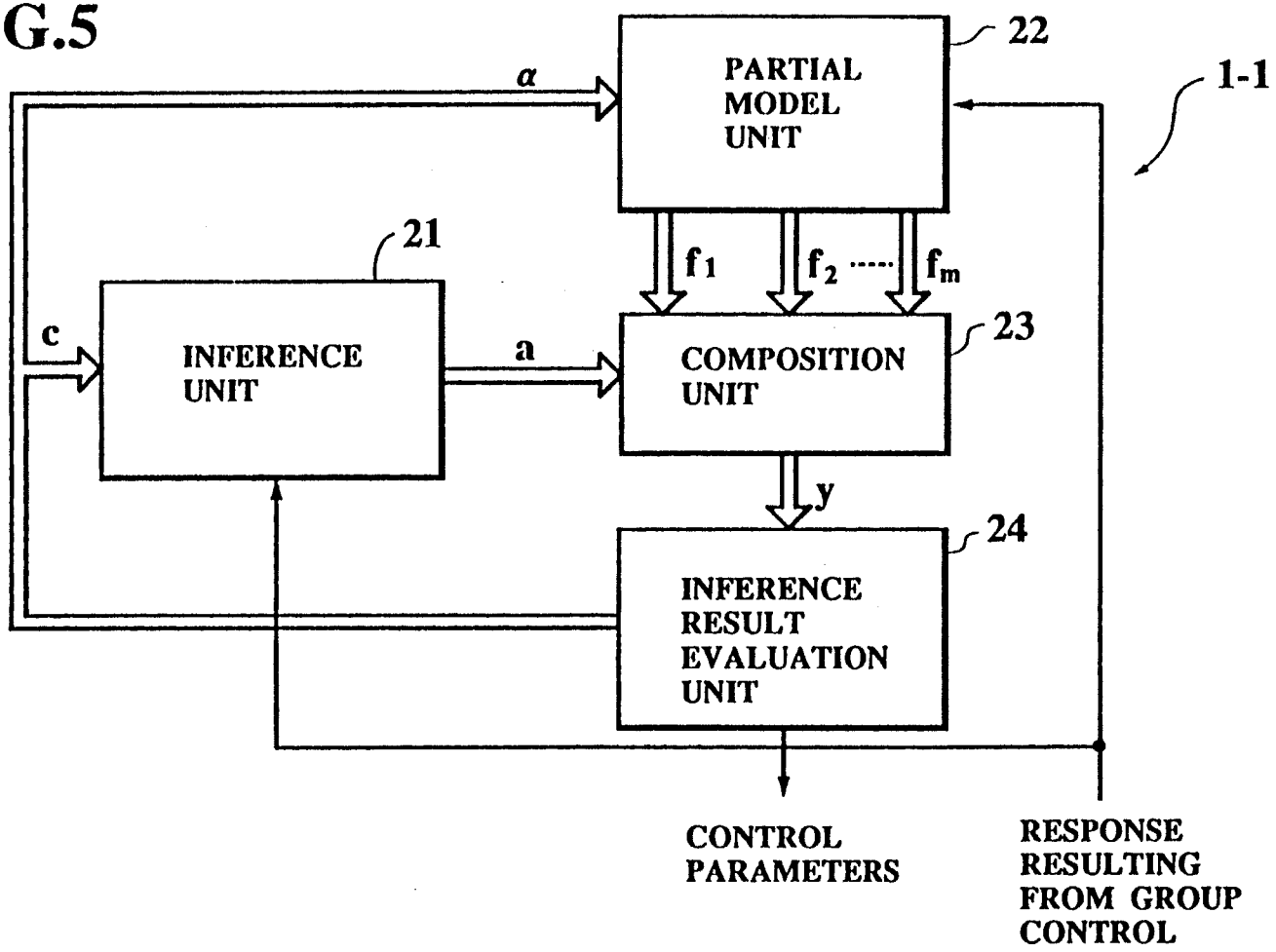
FIG. 5 is a block diagram for a learning control unit of the apparatus of FIG. 1.

As shown in FIG. 5, the learning control unit 1—1 comprises an inference unit 21, a partial model unit 22, a composition unit 23, and an inference result evaluation unit 24.

Here, in general, the group control unit 1 performs the evaluation of a plurality (l in number) of the evaluation characteristics, so that a plurality (l in number) of the evaluation values obtained for an i-th elevator car can be expressed as:

$$g_1(i), g_2(i), \ldots, g_l(i)$$

while the total evaluation value $E_i$ for this i-th elevator car is given as a weighted sum of the evaluation values, which can be expressed as:

$$E_i = \sum_j \alpha_j \cdot g_j(i)$$

where $\alpha_j$ is a weight factor for a j-th evaluation characteristic, which is given from the learning control unit 1—1 to the group control unit 1 as one of the control parameters.

Now, the inference result evaluation unit 24 calculates traffic demands within the prescribed period of time of operation for different time of a day and supplies them to the inference unit 21, while also producing various combinations of the control parameters $\alpha_j$ within a prescribed range and supplying them to the partial model unit 22, and then evaluates the inferred responses resulting from the group control using various combination of the control parameters $\alpha_j$, so as to select the most appropriate combination of the control parameters.

The responses resulting from the group control represented by y, can be expressed in terms of the input represented by u as:

$$y = F(u) \tag{1}$$

In this expression (1), it is assumed that:

$$y = (y_1, y_2, \ldots, y_n)^T$$

and $$u = (u_3, u_e)^T = (C, \alpha)^T$$

In the above expression, $y_1, y_2, \ldots, y_n$ of the responses y represent various data such as those on a rate of occurrences of hall call response time in a given period of time, an average rate of elevator car occupation, and average service time, which will be taken as evaluation reference data for judging the group control performance.

Also, in the above expression for the input u, C represents a traffic demand, which can be expressed as:

$$C = (c_1, c_2, c_3)$$

where $c_1$, $c_2$, and $c_3$ are data on a total average user occurrence interval, an average user occurrence interval at a reference floor, an average user occurrence interval destined to the reference floor, respectively, which express a state of the elevator system such as a crowdedness of the system and a flow of people.

Also, in the above expression for the input u, $\alpha$ represents the weight factors for the evaluation characteristics (i.e., $\alpha$ represents the control parameters) which can be expressed with respect to l evaluation characteristics as:

$$\alpha = (\alpha_1, \alpha_2, \ldots, \alpha_l)$$

In this case, an object model formed by the inference unit 21, partial model unit 22 and composition unit 23 can be expressed as a composition of m partial system models $f_i(\alpha)$, $(i=1, 2, \ldots, m)$, so that the expression (1) described above can be rewritten as:

$$y = \sum_{i=1}^{m} (a_i(C) \cdot f_i(\alpha)) \tag{2}$$

where $a_i(C)$ is an activeness of a partial system model $f_i(\alpha)$ for the traffic demand C, which is determined from relationship between a state of the system obtained from the traffic demand C and the partial system models in the partial model unit 22.

Figure 6:
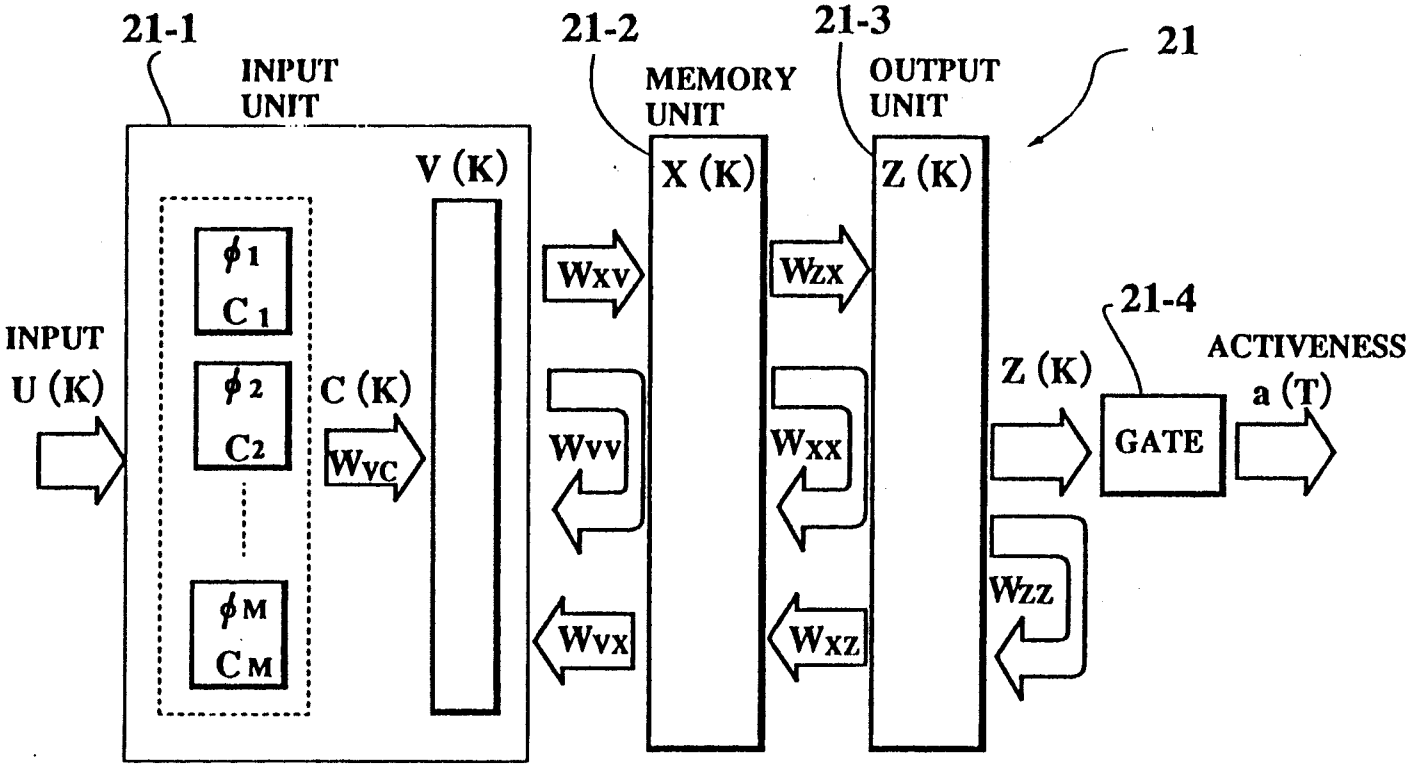
FIG. 6 is a block diagram for an inference unit of the learning control unit of FIG. 5.

As shown in FIG. 6, the inference unit 21 comprises an input unit 21-1, a memory unit 21-2, an output unit 21-3, and a gate unit 21-4, which obtains the activeness $a_i(C)$, $(i=1, 2, \ldots, m)$, appearing in the expression (2) above, in accordance with the state of the system determined on a basis of the traffic demand C given by the inference result evaluation unit 24.

The input unit 21-1 has a k-dimensional state vector V formed by k neurons, and by applying membership functions $\phi_i$ to the input traffic demand C, outputs partial input vectors $C_i$, $(i=1, 2, \ldots, M)$, in which each traffic demand is represented by its membership grade. These M partial input vectors $C_i$ are collectively taken as an input vector C which will be entered into the state vector V.

The memory unit 21-2 comprises an r-dimensional state vector X formed from r neurons, which interrelate the input unit 21-1 and the output unit 21-3.

The output unit 21-3 comprises an m-dimensional state vector Z, where elements $Z_i$, (i=1, 2 . . . , M), of the state vector Z correspond to the partial system models $f_i(\alpha)$ of the partial model unit 22.

As shown in FIG. 6, mutual loops are formed by the input unit 21-1 and the memory unit 21-2, as well as by the memory unit 21-2 and the output unit 21-3, while each of the input unit 21-1, memory unit 21-2, and output unit 21-3 has its own self loop.

These relationships of the input unit 21-1, memory unit 21-2, and output unit 21-3 are of discrete type, which can be expressed by the following expressions.

$$C(k) = \phi(u(k)) \quad (3.1)$$
$$V(k+1) = \psi(W_{VC} \cdot C(k) + W_{VV} \cdot V(k) + W_{VX} \cdot X(k)) \quad (3.2)$$
$$X(k+1) = \psi(W_{VX} \cdot V(k+1) + W_{XX} \cdot X(k) + W_{XZ} \cdot Z(k)) \quad (3.2)$$
$$Z(k+1) = \psi(W_{ZX} \cdot X(k+1) + W_{ZZ} \cdot Z(k)) \quad (3.3)$$
$$V(0) = V_\emptyset$$
$$X(0) = X_\emptyset$$
$$Z(0) = Z_\emptyset$$
$$k \geqq 0$$

where $W_{vc}$ is a matrix representing a weight from the vector C to the vector V, which is a synapse weight of the neurons forming the vector V with respect to the vector C, and similarly $W_{vv}$ is a matrix representing a weight from the vector V to the vector V, which is a synapse weight of the neurons forming the vector V with respect to the vector V, $W_{vx}$ is a matrix representing a weight from the vector X to the vector V, which is a synapse weight of the neurons forming the vector X with respect to the vector V, $W_{xx}$ is a matrix representing a weight from the vector X to the vector X, which is a synapse weight of the neurons forming the vector X with respect to the vector X, $W_{zx}$ is a matrix representing a weight from the vector X to the vector Z, which is a synapse weight of the neurons forming the vector X with respect to the vector Z, and $W_{zz}$ is a matrix representing a weight from the vector Z to the vector Z, which is a synapse weight of the neurons forming the vector Z with respect to the vector Z.

Also, in the above expression (3.1) to (3.4), $\phi$ is a j-dimensional membership function, and $\psi$ is a sigmoid function corresponding to each dimension which performs the following operation for each element x of the input.

$$f(x) = \frac{1}{1 + \exp(-x)} \quad (3.5)$$

Also, in the above expression (3.1) to (3.4), k is a parameter representing time, which increases by one in a unit time.

Thus, by setting each W of the above expressions (3.1) to (3.4), the activenesses $a_i(C)$ of the partial system models $f_i(\alpha)$, (i=1, 2, . . . , m) corresponding to the input traffic demand C(u(k)) appear as the state vector Z from the output unit 21-3 as the time progresses.

The gate unit 21-4 opens after an elapse of a predetermined time T, and outputs $Z_i(T)$ as the activeness $a_i(C)$ of the partial system model $f_i(\alpha)$.

Figure 7:
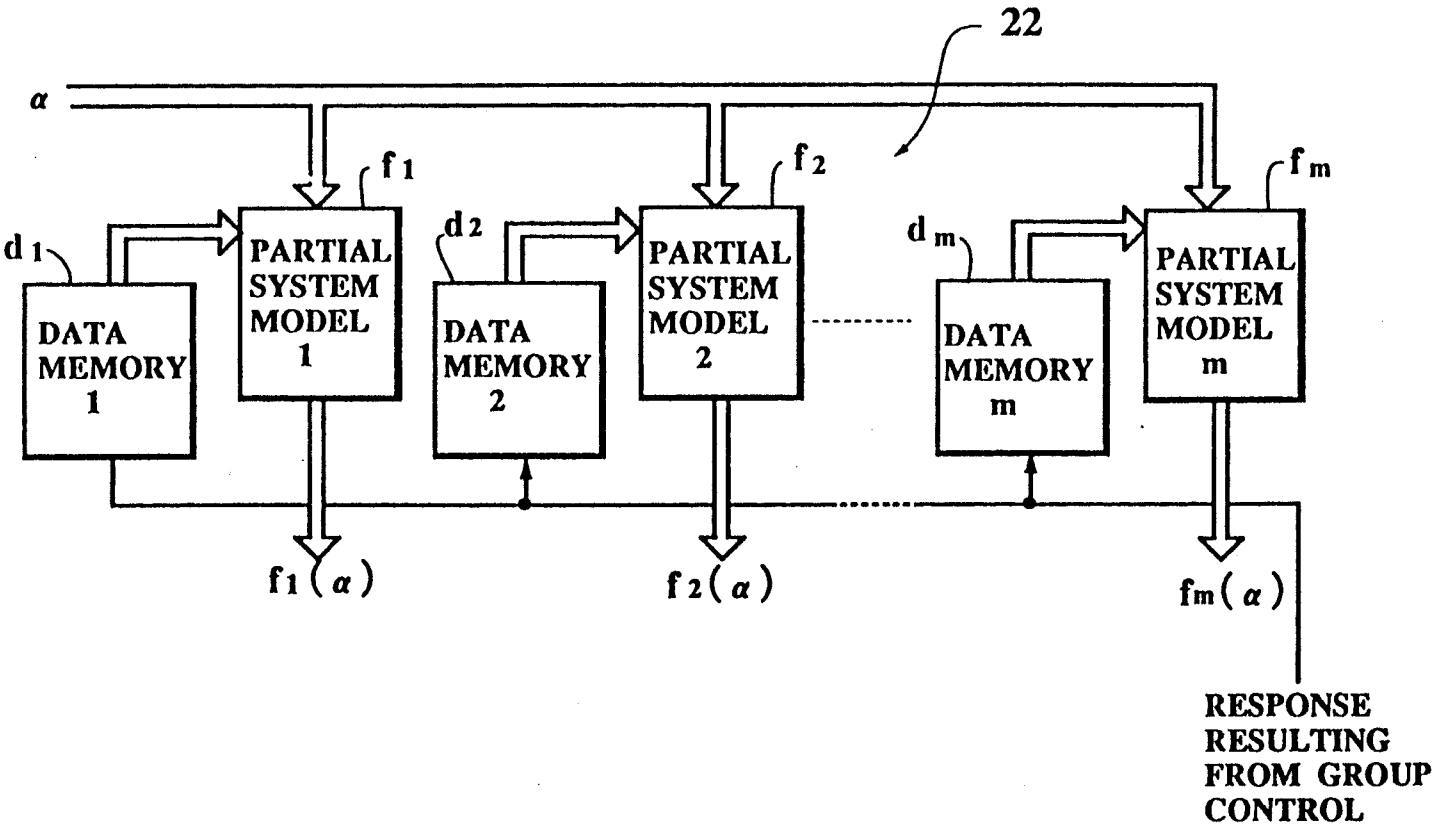
FIG. 7 is a block diagram for a partial system model unit of the learning control unit of FIG. 5.

As shown in FIG. 7, the partial model unit 22 comprises a plurality of partial system models $f_i(\alpha)$, (i=1, 2, . . . , m), each of which outputs the response $f_i(\alpha)$ resulting from the group control by using the input control parameters $\alpha$.

Figure 8:
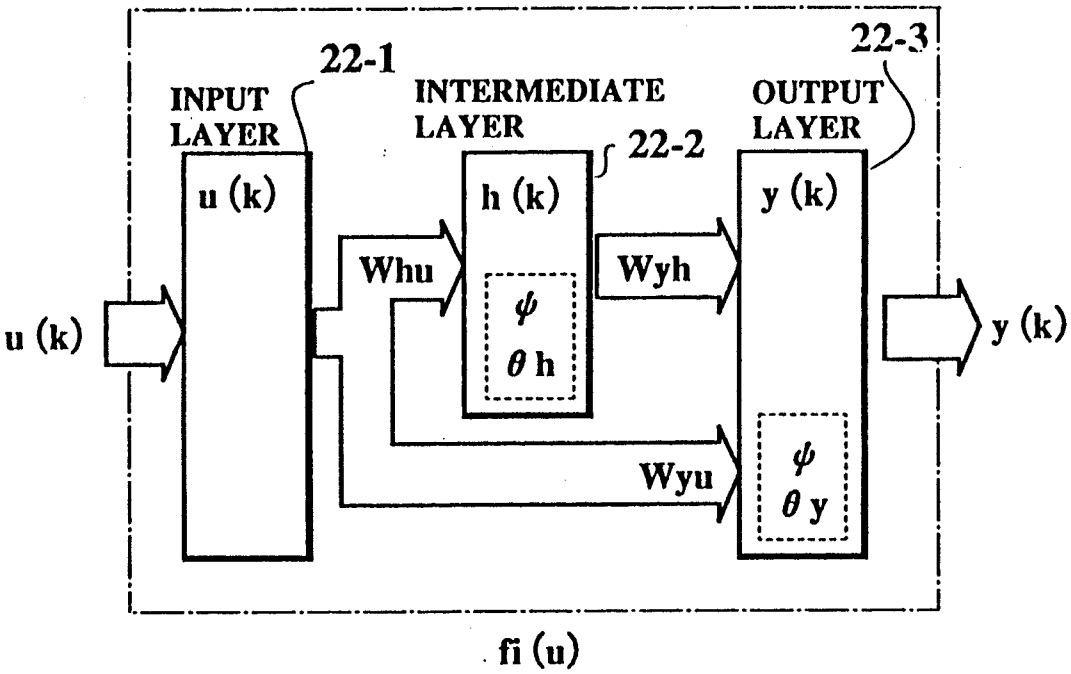
FIG. 8 is a block diagram for a partial system model in the partial system model unit of FIG. 7.

Here, as shown in FIG. 8, each partial system model $f_i(\alpha)$ is made of a multiple layer neural network having an input layer 22-1, an intermediate layer 22-2, and an output layer 22-3. Each partial system model $f_i(\alpha)$ is also equipped with a data memory $d_i$ for memorizing the actual response resulting from the group control in the actual system, which will be utilized as the teacher data in a learning process using the backward error propagation method.

In FIG. 8, when the input u(k) is given, each partial system model $f_i(\alpha)$ performs the following operation on the input u(k).

$$y(k) = f_i(u(k))$$

which is carried out as follows:

$$y(k) = \phi(\text{net } y(k) + \theta_y(k)) \quad (4.1)$$

where $$\text{net } y(k) = W_{yh}(k) \cdot h(k) + W_{yu}(k) \cdot u(k) \quad (4.2)$$

$$h(k) = \phi(\text{net } h(k) + \theta_h(k)) \quad (4.3)$$

$$\text{net } h(k) = W_{hu}(k) \cdot u(k) \quad (4.4)$$

and $$k \geqq 0$$

where $W_{hu}$, $W_{yh}$, and $W_{yu}$ are matrices representing the synapse weights, while $\theta_h$ and $\theta_y$ are bias values with respect to the intermediate layer and the output layer, respectively. Each partial system model $f_i(u)$ possesses the synapse weights different from the other partial system models.

The composition unit 23 obtains the composition of the outputs from the partial system models $f_i(\alpha)$ of the partial model unit 22 and the activenesses $a_i(C)$ for these partial system models $f_i(\alpha)$ given by the inference unit 21, in accordance with the expression (2) given above, and outputs the result as the inference result y for the response resulting from the group control to the inference result evaluation unit 24.

Thus, the Inference result evaluation unit 24 produces various combinations of the control parameters $\alpha$ corresponding to the traffic demand of the actual system, and supplies them to the object model formed by the inference unit 21, partial model unit 22, and composition unit 23 as the input $u=(C, \alpha)^T$, so that in effect the responses resulting from the group control using these various combination of the control parameters $\alpha$ can be evaluated, and the most appropriate control parameters $\alpha$ can be fed to the group control unit 1.

Next, the on-line learning of the inference unit 21 and the partial model unit 22 on a basis of the response resulting from the group control given by the elevator group system 2 will be described.

In a process of learning, an accuracy of the inference unit 21 and related portions of the partial system models $f_i$ are modified in accordance with a difference between the inference result and the response result given by the elevator group system 2. The accuracy is modified counter-proportionally with respect to the largeness of the difference and the activeness, whereas the partial system models are modified proportionally with respect to the largeness of the difference and the activeness.

As shown in FIG. 6, the loop structure for modifying the accuracy of the inference unit 21 is limited to that going from the output unit 21-3 to the memory unit 21-2, i.e., that for the matrix $W_{zx}$. Here, the (i, j) elements $W_{ij}$ of the matrix $W_{zx}$ are modified as follows.

$$W_{ii}=P_i,\ (i=1, 2, , m) \tag{5.1}$$

$$W_{ij}=-P_i,\ (j\neq i) \tag{5.2}$$

where $Pi \geqq 0$ is a parameter representing the accuracy of memorization with respect to partial system model $f_i(\alpha)$, which is given by the following expression.

$$P_i = \xi \cdot R_i(k+1) + \zeta \tag{6.1}$$
$$R_i(k+1) = 1 - \exp[-\beta(N_i(k+1) + \gamma)] \tag{6.2}$$
$$N_i(k+1) = N_i(k) + \delta N_i \tag{6.3}$$
$$\delta N_i = \min\left(1, \eta \frac{a_i}{R_i(k)}\right) \tag{6.4}$$

where $\eta$, $\beta$, $\gamma$, $\epsilon$, and $\zeta$ are constants, Ri and Ni are parameters representing degree of mastery and progress of learning for the partial system model $f_i(\alpha)$, respectively.

The progress of learning $N_i(k)$ represents a level to which the learning has reached after k times of the learning processes performed. This progress of learning Ni(k) is proportional to the activeness $a_i$, and varies according to an extent $\delta N_i \leqq 1$ by which it is counter proportional to the current degree of mastery $R_i(k)$. For every new progress of learning $N_i(k+1)$ obtained by the expression (6.3) above, a new degree of mastery $R_i(k+1)$ can be obtained from the expression (6.2) above.

As for the modification of the partial system model $f_i(\alpha)$, it is achieved by utilizing the backward error propagation method. Here, the data of the data memory $d_i$ associated with each partial system model $f_i(\alpha)$ are rewritten. Namely, after the prescribed period of operation for each time of a day has elapsed, the response resulting from the group control are calculated on a basis of the response result for that time of the day, and the following data memory data:

$$D_\phi=(u_\phi, y_\phi)$$

$$u_\phi=(C_\phi^*, \alpha_\phi)^T$$

are produced along with the control parameters for that time of the day.

Then, the data memory data (D1, D2, . . . , $D_L$) of the partial system model $f_i(\alpha)$ are rewritten as follows.

First, all the data memory data are scanned and a square of the distance between $\alpha_\phi$ and each $\alpha$ given by the expression:

$$d\alpha=|\alpha-\alpha_\phi|^2 \tag{7.1}$$

is obtained, according to which two data $D^{(1st)}$ and $D^{(2nd)}$ for which $\alpha$ is closer to $\alpha_\phi$ than the others are selected.

Next, for these two data $D^{(1st)}$ and $D^{(2nd)}$, a square of a distance between y and $y_\phi$ given by the expression:

$$dy=|y-y_\phi|^2 \tag{7.2}$$

is calculated.

Then, two data $D^{(1st)}$ and $D^{(2nd)}$ are modified according to the following expressions.

$$y_{new}^{(1st)} = \rho_1 \cdot y_\phi + (1-\rho_1) \cdot y_{old}^{(1st)} \tag{7.3}$$

$$y_{new}^{(2nd)} = \rho_2 \cdot y_\phi + (1-\rho_2) \cdot y_{old}^{(2nd)} \tag{7.4}$$

$$\kappa = \frac{1}{\gamma \cdot d^{(1st)}\alpha + 1} \tag{7.5}$$

$$\rho_1 = \delta N_i \cdot \frac{1}{\lambda d^{(1st)} y + 1} \cdot \kappa \tag{7.6}$$

$$\rho_2 = (1-\kappa) \cdot \delta N_i \times \frac{1}{\lambda d^{(2nd)} y + 1} \times \frac{1}{\gamma d^{(2nd)}\alpha + 1} \tag{7.7}$$

The data memory data for the partial system model are rewritten by the expressions (7.3) and (7.4) above, and the rewritten data memory data are utilized as the teacher data in the backward error propagation method by which the weight matrices of the partial system models are modified according to the following expressions.

$$\delta_y(k) = \phi'(\text{net } y(k) + \theta_y(k)) * (y^*(k) - y(k)) \tag{8.1}$$
$$\delta_h(k) = \phi'(\text{net } h(k) + \theta_h(k)) * (W'_{yh} \cdot \delta_y(k)) \tag{8.2}$$
$$\Delta W_{yh}(k+1) = \eta_{yh}(k) \cdot \delta_y(k) \cdot h'(k) + \alpha_{yh} \cdot \Delta W_{yh}(k) \tag{8.3}$$
$$\Delta W_{hu}(k+1) = \eta_{hu}(k) \cdot \delta_h(k) \cdot u'(k) + \alpha_{hu} \cdot \Delta W_{hu}(k) \tag{8.4}$$
$$\Delta W_{yu}(k+1) = \eta_{yu}(k) \cdot \delta_y(k) \cdot u'(k) + \alpha_{yu} \cdot \Delta W_{yu}(k) \tag{8.5}$$
$$W_{yh}(k+1) = W_{yh}(k) + \Delta W_{yh}(k+1) \tag{8.6}$$
$$W_{hu}(k+1) = W_{hu}(k) + \Delta W_{hu}(k+1) \tag{8.7}$$
$$W_{yu}(k+1) = W_{yu}(k) + \Delta W_{yu}(k+1) \tag{8.8}$$
$$\Delta W_{yh}(0) = 0$$
$$\Delta W_{hu}(0) = 0$$
$$\Delta W_{yu}(0) = 0$$
$$\Delta\theta_y(0) = 0$$
$$\Delta\theta_h(0) = 0$$

where y is the teacher data, * denotes matrix multiplication, and $\eta$ and $\alpha$ are learning parameters.

The learning process is continued by increasing the parameter k, one by one, until the relationship:

$$\tfrac{1}{2}|y^*-y|^2<\epsilon$$

comes to hold.

This learning process for modifying the weight matrices of the partial system models is performed whenever new response resulting from the group control is obtained.

Next, referring to FIGS. 9 and 10, the detail configuration of the inference result evaluation unit 24 and an optimal setting of the control parameters $\alpha$ to be performed by the inference result evaluation unit 24 will be described.

Figure 9:
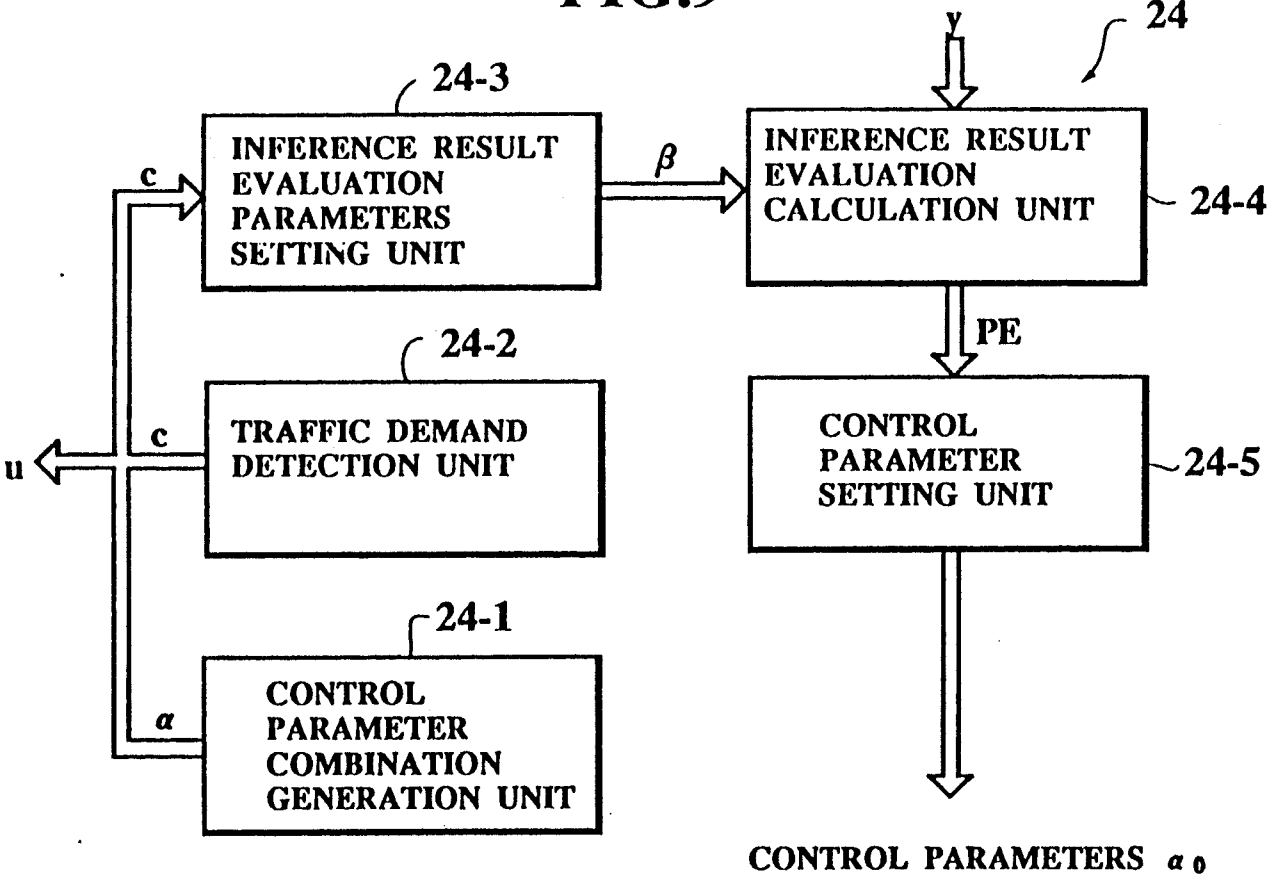
FIG. 9 is a block diagram for an inference result evaluation unit of the learning control unit of FIG. 5.

As shown in FIG. 9, The inference result evaluation unit 24 comprises: a control parameter combination generation unit 24-1; a traffic demand detection unit 24-2; an inference result evaluation parameter setting unit 24-3; an inference result evaluation calculation unit 24-4; and a control parameter setting unit 24-5.

Now, as described above, the response resulting from the group control can be estimated by inference using the expression (1), from the inference unit 21, partial model unit 22, and composition unit 23 of the learning control unit 1—1 in which the relationship between the control parameters and the response resulting from the group control is given for a traffic demand characteristic to each building.

In the inference result evaluation unit 24, the optimal setting of the control parameters is performed in order to obtain the response resulting from the group control with respect to the most appropriate reference for each building which reflects the particularity of the building such as its manner of usage or demand of its tenants.

To this end, the inference result evaluation unit 24 detects the traffic demand at a prescribed time of a day and feeds the detected traffic demand to the inference unit 21. Meanwhile, the inference result evaluation unit 24 also selects the inference result evaluation parameters for the current time from the pre-selected inference result evaluation parameters chosen in accordance with the characteristics of the building.

The inference result evaluation parameters are tabulated set of parameters to be utilized in evaluating the response resulting from the group control, which are pre-selected for each of the different traffic demands of the building, while the response resulting from the group control is, as described above, a parameter indicative of the group control performance, which includes evaluation reference data related to the a rate of occurrences of hall call response time, average rate of elevator car occupation, and average service time.

The evaluation of the group control performance is performed on a basis of the evaluation reference data, but the weights to be given to the evaluation reference data depends on the manner of building usage, demand of the tenants, and traffic demands which are characteristic to each building. For example, in a general office building, the higher priority is given to such terms as the hall call response time and average service time, whereas in a hotel building the higher priority is given to such terms as a low average rate of elevator car occupation. Also, even among the buildings for the same use, the weights varies depending on times of a day, or preferences of tenants. For this reason, the inference result evaluation unit 24 obtains the weight factors in terms of the traffic demands and times of a day in accordance with the characteristic of each building.

The inference result evaluation parameters $\beta$ so obtained for a particular traffic demand C is fed to the inference result evaluation calculation unit 24-2, at which the response y resulting from the group control given by the composition unit 23 is evaluated to obtain a performance evaluation value PE which is subsequently fed to the control parameter setting unit 24-5 so as to set the optimal control parameters $\alpha_{518}$.

More specifically, the optimal control parameter setting by the inference result evaluation unit 24 is carried out according to the flow chart of FIG. 10, as follows.

First, at the control parameter combination generation unit 24-1, each of the control parameters $\alpha$ is varied gradually by an Infinitesimal amount $\Delta\alpha$ within its permitted range, to obtain a finite number of combinations $P(\alpha_{1p}, \alpha_{2p}, \ldots, \alpha_{lp})$ at the steps S1 and S2.

Next, at the step S3, according to the current traffic demand C detected by the traffic demand detection unit 24-2 and the control parameter combinations generated at the step S2, the input $u=(C, \alpha)^T$ are fed to the inference unit 21 and the partial model unit 22, to obtain the response $y_p$ resulting from the group control from the composition unit 23.

Then, at the step S4, the performance evaluation value PE as a function to indicate the group control performance is produced by using a mathematical model, on a basis of the response $y_p$ obtained at the step S3. Here, the performance evaluation value $PE_p$ for the combination P is given by the following expression:

$$PE_P = \sum_{i=1}^{n} \beta_i \cdot y_i \tag{9}$$

where $\beta=(\beta_1, \beta_2, \ldots, \beta_n)$ are inference result evaluation parameters, which are pre-selected for different traffic demands and different times, in accordance with the characteristic of each building.

This evaluation of the performance evaluation value $PE_p$ is repeated for all the combinations P ranging from 0 to Pmax by the step S5.

Finally, when the performance evaluation value $PE_p$ is evaluated for all the combinations P at the step S5, the combination P which minimize the performance evaluation value $PE_p$ is selected as $P_\emptyset$, and the control parameters $P_\emptyset(\alpha_{1p\emptyset}, \alpha_{2p\emptyset}, \ldots, \alpha_{lp\emptyset})$ are selected as the optimal control parameters which are subsequently fed to the group control unit 1 at the step S6.

As described, according to this embodiment of the elevator group control apparatus, in the hall call allocation control, the control parameters which are the weight factors for evaluation characteristics to evaluate the group control performance can be optimized in accordance with the traffic demand, by providing the learning control unit 1—1 including the inference unit 21, partial model unit 22, composition unit 23, and inference result evaluation unit 24, so that it becomes possible to automatically set the most appropriate control parameters according to the characteristics of each building.

Also, because the Inference unit 21 and the partial model unit 22 can perform the on-line learning on a basis of the response resulting from the group control, so that highly adaptable autonomous system can be constructed.

Figure 11:
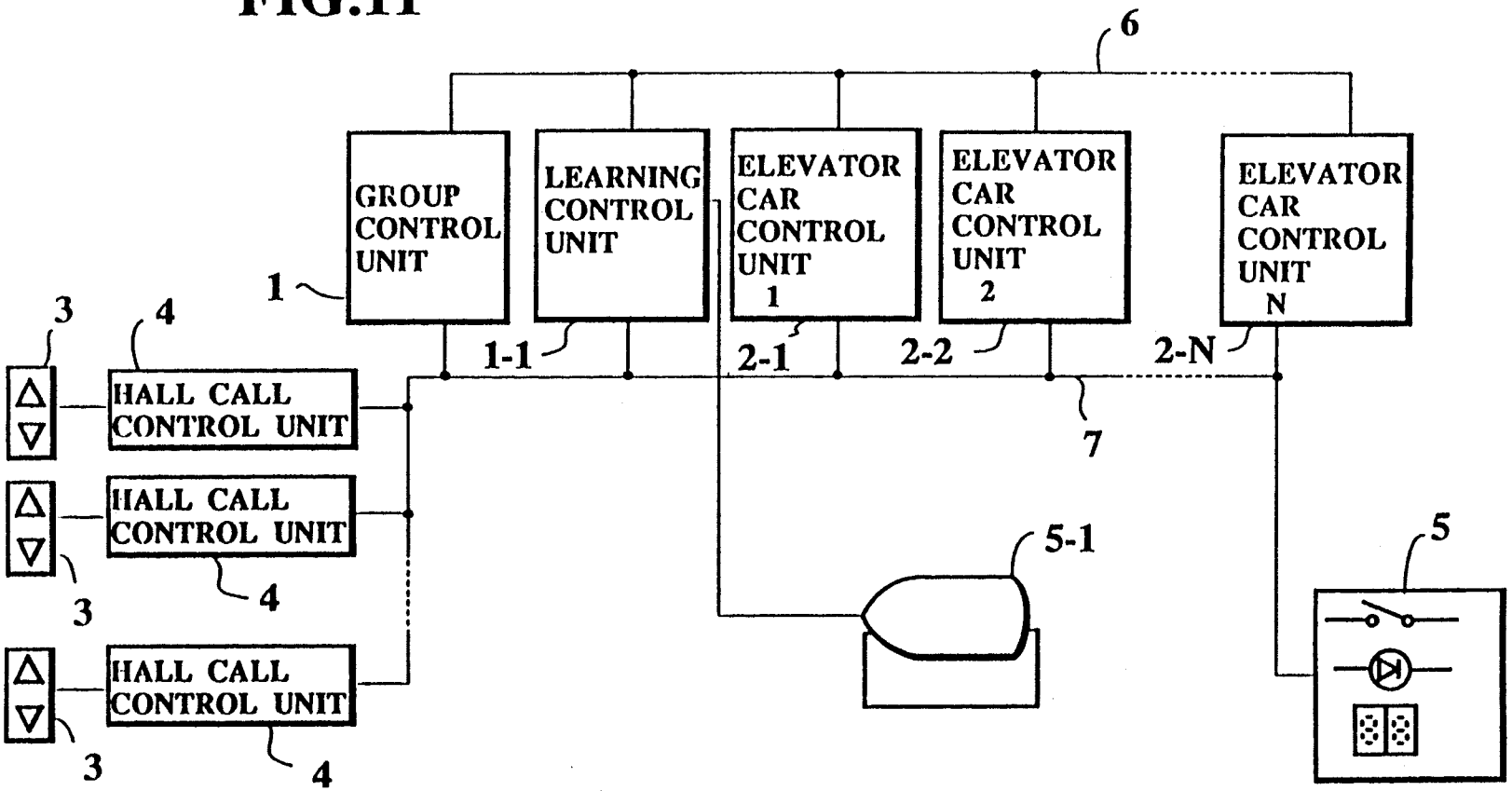
FIG. 11 is a schematic block diagram of another embodiment of an elevator group control apparatus according to the present invention.

Referring now to FIG. 11, another embodiment of an elevator group control apparatus according to the present invention, which can conveniently be viewed as a variation of the previous embodiment, will be described. In the following, the description of those elements which are substantially equivalent to the corresponding elements of the previous embodiment will be omitted, and such elements are given the identical labels in the drawings.

As shown in FIG. 11, in this embodiment the apparatus of the previous embodiment is further equipped with an input and output device 5-1 functioning as a man-machine interface, which has a display device such as a CRT. This input and output device 5-1 is placed in a separate room such as a superintendent's office where a user can operate on the input and output device 5-1. The input and output device 5-1 is connected with the learning control unit 1—1, such that the user can evaluate the inference result for the response resulting from the group control in a dialogue style, in order to select the most appropriate response result.

Here, after the inference result evaluation unit 24 calculates traffic demands within the prescribed period of time of operation for different time of a day and supplies them to the inference unit 21, while also producing various combinations of the control parameters $\alpha_j$ within a prescribed range and supplying them to the partial model unit 22, and then evaluate the inferred responses resulting from the group control using various combination of the control parameters $\alpha_j$, just as in the previous embodiment, the obtained inference result for the response is shown to the user through the input and output device 5-1. so that the user can select the most appropriate combination of the control parameters.

Now, as in the previous embodiment, the optimal setting of the control parameters is performed by the inference result evaluation unit 24 in order to obtain the response resulting from the group control with respect to the most appropriate reference for each building which reflects the particularity of the building such as its use or demand of its tenants.

In this embodiment, the inference result evaluation unit 24 detects the traffic demand at a prescribed time of a day and feeds the detected traffic demand to the inference unit 21, while also determining the optimal values for the control parameters in accordance with the inference result evaluation parameters chosen by the user at the input and output device.

Now, as already mentioned in the description of the previous embodiment, the evaluation of the group control performance is performed on a basis of the evaluation reference data, but the weights to be given to the evaluation reference data depends on the manner of building usage, demand of the tenants, and traffic demands which are characteristic to each building. For this reason, in this embodiment, the most appropriate response resulting from the group control is selected and the inference result evaluation parameters corresponding to the selected response resulting from the group control are chosen as the weight factors to be utilized in the evaluation of the actual response resulting from the group control, while the user inspects the response resulting from the group control in a dialogue style on the input and output device.

Figure 10:
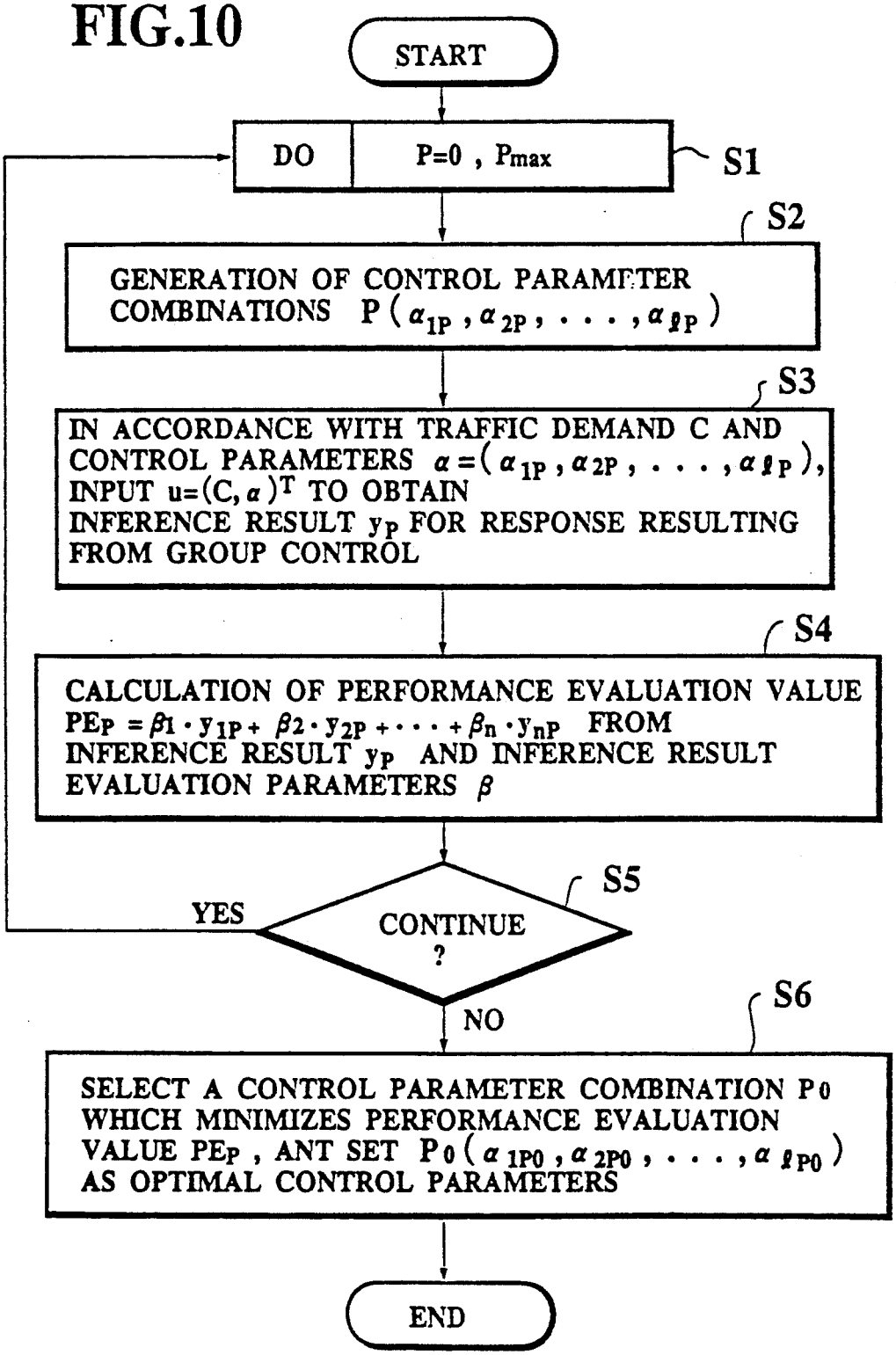
FIG. 10 is a flow chart for a process of the optimal control parameter setting to be performed by the inference result evaluation unit of FIG. 9.

Thus, in this embodiment, $\beta=(\beta_1, \beta_2, \ldots, \beta_n)$ appearing in the process of the optimal control parameter setting to be carried out according to the flow chart of FIG. 10, are inference result evaluation parameters, which reflect the response resulting from the group control that the user has evaluated through the input and output device 5-1.

Referring now to the flow charts of FIGS. 12 and 13, the operation at the input and output device 5-1 by which the user's opinion on the response resulting from the group control are taken into account will be described in detail.

First, as the initial inputs, the user is asked to specify the a particular time of a day at the step S11, to select the traffic demand parameters at the step S12, and to enter the importance of each of the evaluation characteristics in view of the group control performance at the step S13.

The input of the importance of each of the evaluation characteristics is carried out in a dialogue style in which the user is questioned as to which characteristic is to be considered important in view of the group control performance and required to answer the question by indicating his choices from the evaluation references such as a rate of occurrences of hall call response time, average rate of elevator car occupation, and average service time. For example, in a hotel building the heavier weights are given to the average rate of elevator car occupation and the average service time, whereas in the general office building, the hall call response time is further sub-divided into sub-categories such as an average waiting time and a probability of long waiting, from which the desired terms to be given the heavier weights are selected by the user.

Next, at the step S14, in accordance with the importance of each of the evaluation characteristics specified by the user, the corresponding inference evaluation parameters $\beta$ are set.

Then, at the step S15, the inference result $y_{p\phi}$ for the response resulting from the group control which minimizes the performance evaluation value PE is determined in accordance with the selected inference evaluation parameters $\beta$.

More specifically, this calculation at the step S15 is carried out according to the flow chart of FIG. 13 as follows.

First, at the control parameter combination generation unit 24-1, each of the control parameters $\alpha$ is varied gradually by an infinitesimal amount $\Delta\alpha$ within its permitted range, to obtain a finite number of combinations $P(\alpha_{1p}, \alpha_{2p}, \ldots, \alpha_{lp})$ at the step S22.

Next, at the step S23, the current traffic demand C detected by the traffic demand detection unit 24-2 as well as the input $u=(C, \alpha)^T$ are fed to the inference unit 21 and the partial model unit 22, to obtain the response $y_p$ resulting from the group control from the composition unit 23.

Then, at the step S24, the performance evaluation value PE as a function to Indicate the group control performance is produced by using a mathematical model, on a basis of the response $y_p$ obtained at the step S23.

This evaluation of the performance evaluation value $PE_p$ is repeated for all the combinations P ranging from 0 to Pmax by the step S25.

Finally, when the performance evaluation value $PE_p$ is evaluated for all the combinations P at the step S25, the the inference result $y_{p\phi}$ for the response resulting from the group control which minimize the performance evaluation value $PE_p$ is determined. The inference result $y_{p\phi}$ for the response resulting from the group control so determined represents the estimated value for the response resulting from the group control reflecting the importance of each of the evaluation characteristics specified by the user.

Figure 12:
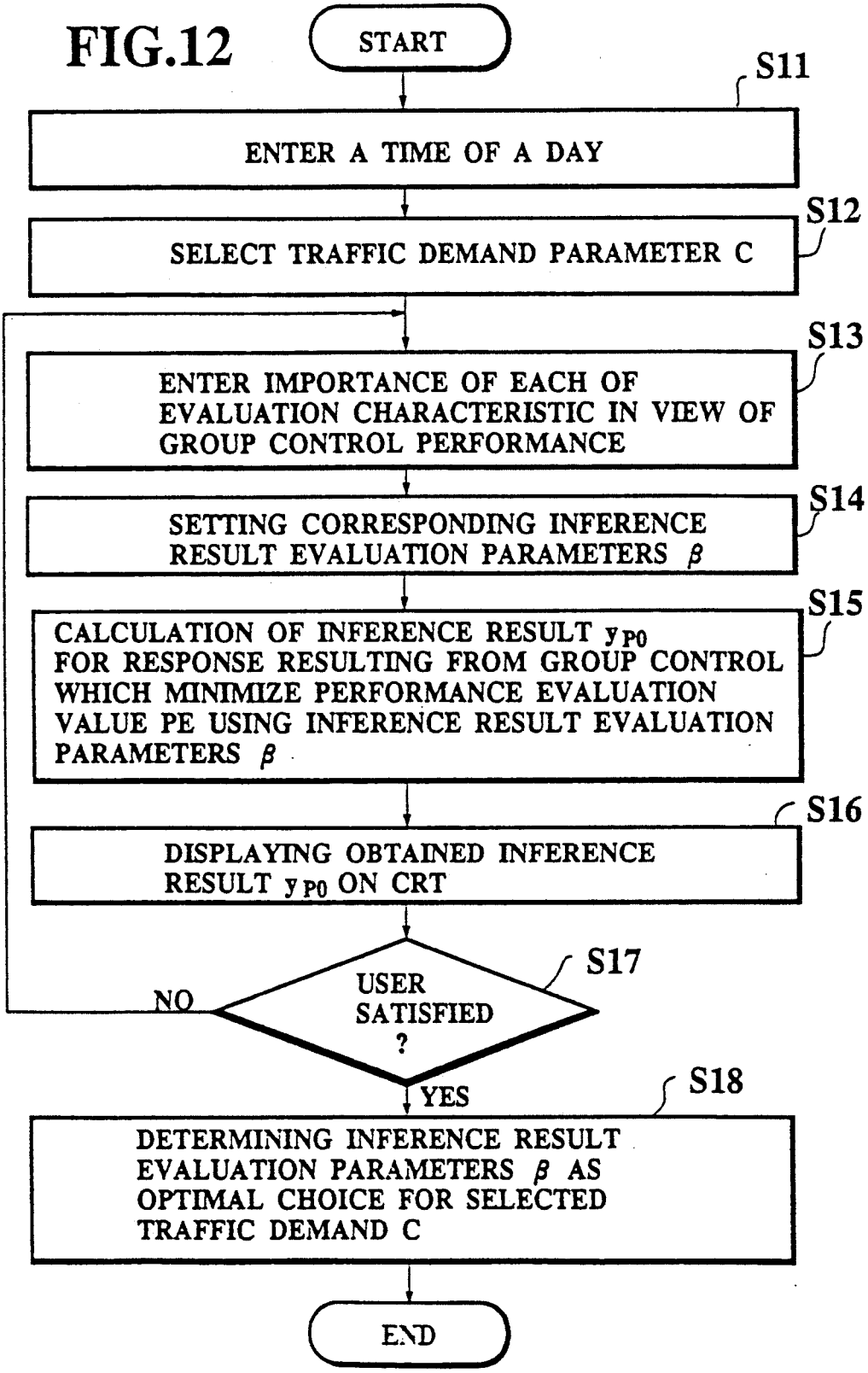
FIG. 12 is a flow chart for the operation to be performed at the input and output device of the apparatus of FIG. 11.
Figure 13:
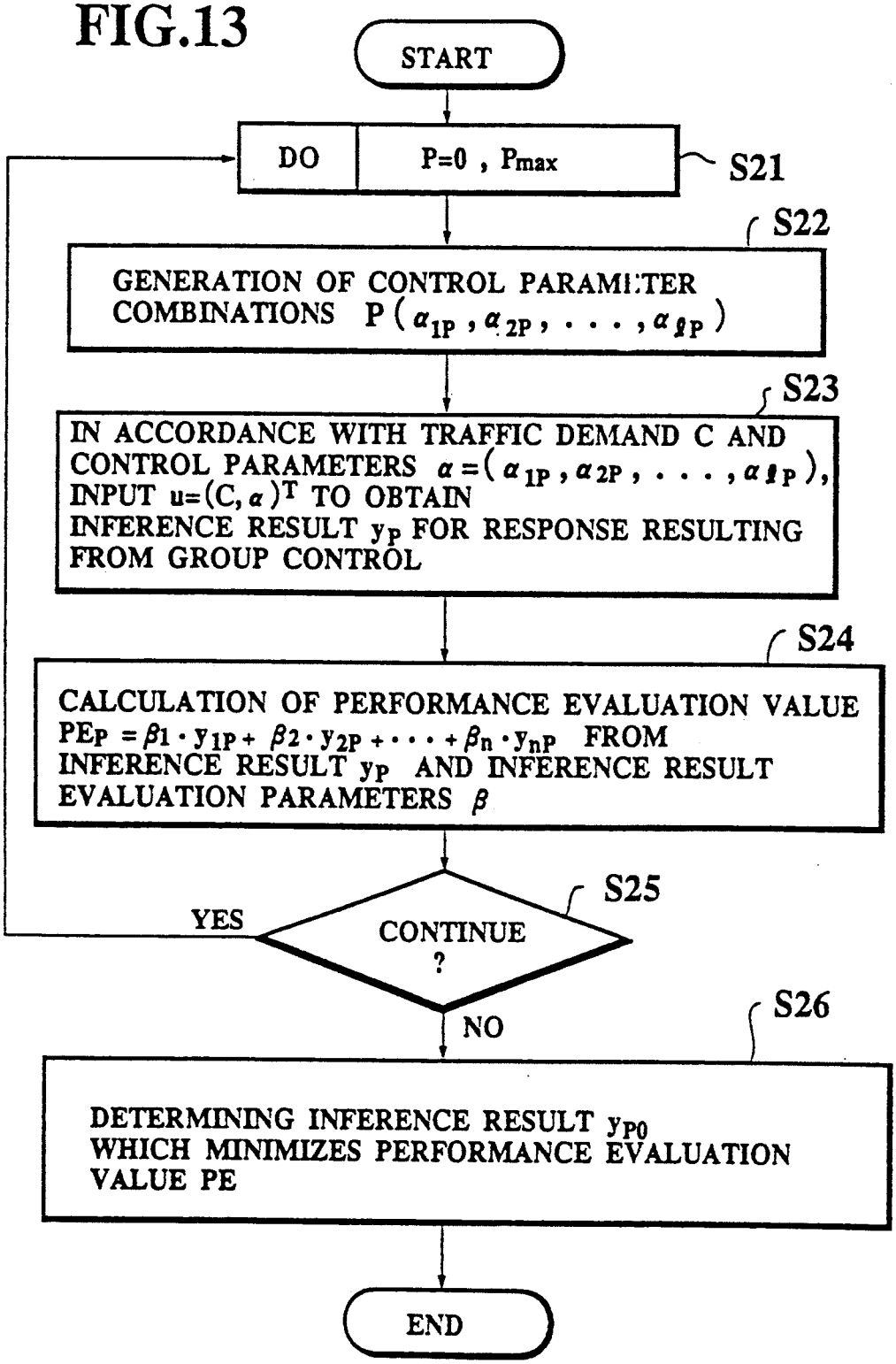
FIG. 13 is a flow chart for a calculation to be carried out at one step of the flow chart of FIG. 12.

Referring back to the flow chart of FIG. 12, the input and output device 5-1 next displays the obtained inference result $y_{p\phi}$ for the response resulting from the group control on the CRT of the input and output device 5-1 at the step S16, so that the user can inspect this result, and then request the user's approval at the step S17.

If the user is not satisfied with the displayed result, the process returns to the step S13 above, and the user is asked to re-enter the importance of each of the evaluation characteristics, on a basis of which the above described process is to be repeated.

On the other hand, if the user is satisfied with the displayed result, the selected inference result evaluation parameters $\beta$ are determined as the optimal choice for this particular traffic demand C, so that these are fed to the learning control unit 1—1, in order to be utilized in the process of the optimal control parameter setting to be carried out according to the flow chart of FIG. 10.

Thus, according to this embodiment, the preference of the user can easily be reflected in the setting of the control parameters by operating the input and output device 5-1 as described above.

As has been described above, according to the present invention, it becomes possible to set the most appropriate control parameters in accordance with the continuously changing traffic demand for different times of a day in each building, because the relationship between control parameters and the response resulting from the group control can be estimated quantitatively for an arbitrary traffic demand, by means of the learning control unit including the partial system models unit constructed from the function models formed by the neural networks which vaguely classifies the relationships between the control parameters and the response resulting from the group control, the inference unit relating the partial system models with the traffic demands using a plurality of membership functions, and the composition unit for calculating the response resulting from the group control in accordance with the results obtained by the inference unit and the partial model unit.

Also, the control parameters most appropriate for each building can be set in accordance with the characteristics of each building, so that different buildings having widely different situations such as hotel buildings, tenant buildings, and single company buildings can be dealt with.

Moreover, even when the most appropriate evaluation reference is changed in a course of building use, the apparatus of the present invention can adapt itself quickly to the changed circumstances by modifying the inference result evaluation parameters.

Furthermore, the apparatus of the present invention can obtain the inference result for the response resulting from the group control with respect to different control parameters by means of the learning control unit, even when there is no prepared data which coincide with the actual traffic demand realized in the building, so that any arbitrary traffic demands can be dealt with.

Also, the on-line learning by the learning control unit enable to construct the highly adaptable autonomous system.

In addition, by using the man-machine interface, the preference of the user can easily be reflected in the setting of the control parameters, which enhances the flexibility of the elevator system.

These features enable the apparatus of the present invention to perform the optimal hall call allocation control regardless of the characteristics of the building.

It is to be noted that although in the above embodiments, the inference result evaluation parameters are weighted and linearized in evaluating the inference result, the ideal response result may be set as reference values in advance, and the optimal control parameters may be set by selecting those control parameters for which the deviation from the reference values is minimum.

It is also to be noted that although in the above embodiments, the evaluation of the inference result for the response resulting from the group control is performed in terms of the inference result evaluation parameters, this evaluation may be made directly on the inference result, omitting the conversion of the inference result into the inference result evaluation parameters.

Besides these, many modifications and variations of the above embodiments may be made without departing from the novel and advantageous features of the present invention. Accordingly, all such modifications and variations are intended to be included within the scope of the appended claims.

What is claimed is:

1. An elevator group control apparatus for performing an elevator group control of an elevator system including a plurality of elevator cars and a plurality of destination floors, comprising:

a group control unit for determining a most appropriate one of said elevator cars to respond to a hall call produced at one of said destination floors, by carrying out evaluations of performances of said elevator group control by weighting evaluation reference data in accordance with a traffic demand of said elevator system and generating a hall call allocation control signal;

an elevator control unit, receiving said hall call allocation control signal, for controlling operations of said elevator cars; and a learning control unit for determining control parameters to be utilized by said group control unit in carrying out said evaluations, in accordance with a response of said most appropriate one of said elevator cars to said hall call, resulting from said hall call allocation control signal from said group control unit and said traffic demand of said elevator system such that the evaluations carried out by said group control unit take into account performances of said elevator group control;

wherein said group control unit carries out said evaluations defined in terms of sums of evaluation characteristics weighted by said control parameters, and wherein said learning control unit comprises:

a partial model unit including a plurality of partial system models representing relationships between said control parameters and said responses for different traffic demands, said partial system models being given in forms of neural networks;

an inference unit for determining weight factors for said partial system models, by expressing relationships between said partial system models and said different traffic demands in terms of a plurality of membership functions;

a composition unit for obtaining an estimated response in accordance with said partial system models and said weight factors; and an inference result evaluation unit for determining said control parameters in accordance with said estimated response.

2. The apparatus of claim 1, wherein said inference result evaluation unit includes a man-machine interface means for allowing a user to alter said determination of said control parameters on a basis of said user's evaluation of said estimated response.

3. The apparatus of claim 1, wherein said neural networks perform learning of actual responses resulting from said hall call allocation control signal by using a backward error propagation method with said actual responses as teacher data.

4. A method of elevator group control for controlling an elevator system including a plurality of elevator cars and a plurality of destination floors, comprising the steps of:

performing a hall call allocation control to determine a most appropriate one of said elevator cars to respond to a hall call produced at one of said destination floors, by carrying out evaluations of performances of said elevator group control in accordance with a given traffic demand of said elevator system;

controlling operations of said elevator cars according to said hall call allocation control performed; and determining control parameters to be utilized at the performing step in carrying out said evaluations, in accordance with a response of said most appropriate one of said elevator cars to said hall call, resulting from said hall call allocation control and said given traffic demand of said elevator system such that said evaluations carried out at said performing step take into account past performance of said elevator group control;

wherein at said performing step, said evaluations are carried out in terms of weighted sums of evaluation characteristics weighted by said control parameters, and wherein said determining step includes the steps of:

(1) constructing a plurality of partial system models representing relationships between said control parameters and said responses for different traffic demands, said partial system models being given in forms of neural networks;

(2) determining weight factors for said partial system models, by expressing relationships between said partial system models and said different traffic demands in terms of a plurality of membership functions;

(3) obtaining an estimated response in accordance with said partial system models and said weight factors; and (4) calculating said control parameters in accordance with said estimated response.

5. The method of claim 4, wherein the step (4) further includes a step of allowing a user to affect the determination of said control parameters on a basis of said user's evaluation of said estimated response.

6. The method of claim 4, wherein the neural networks perform learning of actual responses resulting from said hall call allocation control by using a backward error propagation method with said responses as teacher data.

* * * * *